US007093783B2

(12) United States Patent
Warren et al.

(10) Patent No.: US 7,093,783 B2
(45) Date of Patent: Aug. 22, 2006

(54) ELONGATE MATERIAL MANAGEMENT APPARATUS

(76) Inventors: Jessica S. Warren, 2053 E. Bayshore Rd., #46, Redwood City, CA (US) 94063; Brian N. Warren, 2053 E. Bayshore Rd., #46, Redwood City, CA (US) 94063

( * ) Notice: Subject to any disclaimer, the term of this patent is extended or adjusted under 35 U.S.C. 154(b) by 100 days.

(21) Appl. No.: 10/746,544

(22) Filed: Dec. 29, 2003

(65) Prior Publication Data

US 2005/0145739 A1 Jul. 7, 2005

(51) Int. Cl.
*B65H 75/48* (2006.01)

(52) U.S. Cl. ..... 242/385.4; 242/378.1

(58) Field of Classification Search ..... 242/376, 242/378.1, 385.4, 379
See application file for complete search history.

(56) References Cited

U.S. PATENT DOCUMENTS 3,084,886 A * 4/1963 Bastow ..... 242/375
4,901,938 A * 2/1990 Cantley et al. ..... 242/378.1
5,520,212 A 5/1996 Williams
5,669,571 A * 9/1997 Graybill ..... 242/378.1
5,890,529 A 4/1999 Haarer
5,957,400 A 9/1999 Brannen
6,293,485 B1 9/2001 Hollowed
6,328,243 B1 * 12/2001 Yamamoto ..... 242/378.1
6,392,635 B1 5/2002 Snyder
2002/0001990 A1 1/2002 Ellis
2002/0007535 A1 1/2002 Koppang
2002/0126978 A1 9/2002 Holman
2002/0137392 A1 9/2002 Wainio
2002/0143296 A1 10/2002 Russo
2003/0209625 A1 11/2003 Alson

* cited by examiner

*Primary Examiner*—John Q. Nguyen

(57) ABSTRACT

Disclosed is an elongate material management apparatus. It is comprised of a housing removably connected to a base plate that may be opened for the placement of tubing therein. Disposed within the housing is a dual spool to wind and unwind tubing. The dual spool is disposed on a spindle vertically supported on the base plate. The dual spool include a u-turn channel to reverse the direction of the tubing without collapsing it so that the tubing can either wind up or unwind from both of halves of the dual spool simultaneously. The dual spool is energized with a torsional drive that may be a coil spring to wind up unused tubing, one end of which is attached to a slot in the dual spool while the other is attached to the housing to achieve mild tension in the tubing from both directions. The inventive apparatus also includes a ratchet and pawl type device to selectively hold the dual spool in a given position without tension being on the tube when it is not needed. The apparatus includes an interlock that prevents removing the base plate from the housing unless the elongate material has been fully unwound to fully tension the torsion drive, a lock on the dual spool to maintain full tension on the torsion drive when the base plate is removed from the housing to facilitate exchanging elongate materials; and a release button on the base plate to release the stop when the base plate is reassembled with the housing to initiate winding of the elongate material.

11 Claims, 2 Drawing Sheets

ELONGATE MATERIAL MANAGEMENT APPARATUS

BACKGROUND OF THE INVENTION

1. Field of the Invention

The present invention relates to the field of apparatus to wind and unwind from their center extremely elongate materials such as tubing, cord, rope, wire and the like where the ends of same are in use and cannot be conveniently disconnected or disturbed. More specifically, the invention relates to a device that winds up and unwinds tubing or similar materials according to the presence or absence of mild tension between the ends that are attached to other apparatus to compensate for varying distances between the ends. In its preferred embodiment, the proximal end of tubing is attached to a breathing tube or oxygen mask connected to a medical patient, while the distal end is attached to an oxygen tank. The oxygen tank remains stationary in use while the ambulatory medical patient moves about the room, and the inventive apparatus compensates for the varying length of the tubing. In effect the tubing is wound up or unwound from its center. The invention accomplishes this while avoiding any collapse of the tubing so that fluid flow is not interrupted.

2. Description of the Prior Art

The present invention finds its genesis in the circumstance where an ambulatory medical patient in need of oxygen therapy has limited options for mobility. That is, the patient must stay very close to the oxygen tank essentially eliminating his or her mobility, or move the tank with him or her. In the prior art increasing that mobility has required the use of small light weight low capacity wheeled oxygen tanks or the use of long tubes that may be up to thirty feet in length. Such tubes are cumbersome, get tangled, end up being dragged on the floor, and not uncommonly trip either the patient or the patient's visitors. It is the mobility of a person seeking to move about a room and the avoidance of the latter problems in the prior art that the present invention addresses. It also addresses the additional problems of tangling that are magnified when two or more people connected to oxygen tanks are moving about in the same room at the same time.

Several devices are known in the prior art for the control and management of elongate materials such telephone wires, computer cords, and electrical extension cords. There are, for example, vacuum cleaners with automatic cord retrieving mechanisms. There are also believed to be modern analogue phone lines winders.

Examples of the prior art which have been located in a search by applicants are as follows: Williams, U.S. Pat. No. 5,520,212, teaches a device for winding and unwinding a hose. However, it is incapable of winding a hose from its midpoint so that both ends are moved toward to the reel at the same time. The next reference is Brannen, U.S. Pat. No. 5,957,400 for a self winding hose reel. It teaches it is possible to drive a hose reel by connection between wheels supporting the reel turning on the ground and connecting to the reel. However, Brannen suffers from the same deficiency as the preceding reference.

Snyder, U.S. Pat. No. 6,392,635 shows a coiling type device disposed within a computer mouse to retract the connecting cord as the mouse is moved about. It also suffers from the same deficiency.

The next reference is Holman, et. al. U.S. Patent Application Publication No. U.S. 2002/0126978 A1. Holman, et. al. teach a plurality of spools in a container, but do not teach piling up a elongate material from its center. A further references Alson, U.S. Patent Application Publication No. U.S. 2003/0209625 A1 for a cable-winder device that is multi-functional. However, it does not teach winding any elongate material such as a cable from its center. The next reference it is Holloweb, U.S. Pat. No. 6,293,485 for a two-stage retractable cord reel. This reference teaches a complex mechanical device that includes a pilot mechanism and latch mechanism, but it has the same deficiencies as the other references.

A further reference is Haarer, U.S. Pat. No. 5,890,529 which teaches a dual action retractable cord take-up reel. It is also a fairly complex mechanism that is intended to operate window coverings such as shades. It does not teach winding up any elongate material from its center. In fact, the two reels wind and unwind cord that is not connected from one reel to the other, the reels operate separately, and both cannot wind or unwind at the same time. Other references of lesser interest are Wainio, U.S. Patent Application Publication No. U.S. 2002/0137392 A1, Koppang, U.S. Patent Application Publication No. U.S. 2002/0007535 A1, Ellix, U.S. Patent Application Publication No. U.S. 2002/0001990 A1 and Russo, U.S. Patent Application Publication No. U.S. 2002/0143296 A1.

SUMMARY OF THE INVENTION

Bearing in mind the foregoing, it is a principal object of the present invention to provide a device that acts as a self-retracting "leash" with a mild tension that assures that tubing will not be tangled underfoot for in such other equipment for at the same time providing for release of the tube when additional tension is applied to it.

A related principal object of the invention is to provide a device which winds tubing from both sides, i.e., from the proximal end and distal end simultaneously, while unwinding tubing from both sides at other times.

An additional object of the invention is to provide a elongate material apparatus which is essentially fool proof for use by both the elderly and elder care workers. It is to provide a device which will have sufficient accumulation strength to draw in tubing not in use but having such minimal tension that it will not tug a breathing tube out off a user's nostrils.

A further object of the invention it is to provide a device meeting the foregoing objectives which is lightweight, readily moved about the floor of a room by elderly ambulatory patients and with low cost so that it is available for widespread use by its most probable constituency.

Another object of the invention is to accomplish the foregoing objectives with a device that avoids collapse of tubing so that the flow of fluid in that tubing is not interrupted.

A further object of the invention is to include an interlock to prevent the housing from being opened until the torsion spring that applies tension and winding force to the elongate material is fully wound, accomplished by full unwinding of the elongate material.

A closely related object on the invention is to equip the apparatus with a stop and release, the stop to retain the torsion spring in its fully wound position when the housing is opened to change elongate material, and the release to cause the torsion spring to automatically fully wind up the elongate material after the housing has been closed.

Other objects and advantages will become apparent to those skilled in the art upon reference to the following descriptions and the appended drawings.

In accordance with a major aspect of the present invention, the apparatus is comprised of a housing removably connected to a base plate so that the housing may be opened for the placement of tubing therein. Disposed within the housing is preferably a pair of spools joined together that allow tubing to be wound upon them without causing a collapse thereof. The dual spool is preferably disposed on a spindle which acts as an axis for the dual spools. The spindle is vertically supported on the center of the base plate. A first end of the spindle contacts a compression plate that includes a compression urging device such as a spring while a second end of the spindle is equipped with locking tabs to prevent the dual spool from coming off of the spindle. Disposed at given point about the periphery of the dual spool is a u-turn channel. This is so that the tubing can reverse direction when it passes from the first half of the dual spool to the second half of the dual spool because it must either wind up or unwind from both of halves of the dual spool simultaneously. The dual spool is energized with a torsional drive that may be a coil spring to wind up unused tubing, one end of which is attached to a slot in the dual spool while the other is attached to the housing to achieve mild tension in the tubing from both directions. The inventive apparatus also includes an optionally operative ratchet and pawl type device to hold the dual spool in a given position without tension being on the tube when it is not needed. This is preferably comprised of at least one spring loaded button on the top side of the dual spool to interact with a plurality of similarly sized recesses, preferably holes, in the top of the housing. The effect is to hold the dual spool stationary when appropriate, but to initiate rotational motion of the dual spool to either wind or unwind tubing as needed when a slight tug is made on the tubing to dislodge the button from one of holes. In many instances, this ratchet and pawl feature is intentionally disabled, such as by selectively locking the spring loaded button in the down position. The latter mode of operation is indicated when the invention is used with an oxygen tank and a breathing tube on an elderly patient who could not be expected to remember to tug on the tubing to resume winding and tension when walking closer to the oxygen tank.

BRIEF DESCRIPTION OF THE DRAWINGS

Various other features of the invention will become apparent to those skilled in the art from the following discretion taken in conjunction with the appended drawings, in which.

DETAILED DESCRIPTION OF THE PREFERRED EMBODIMENTS

Figure 1:
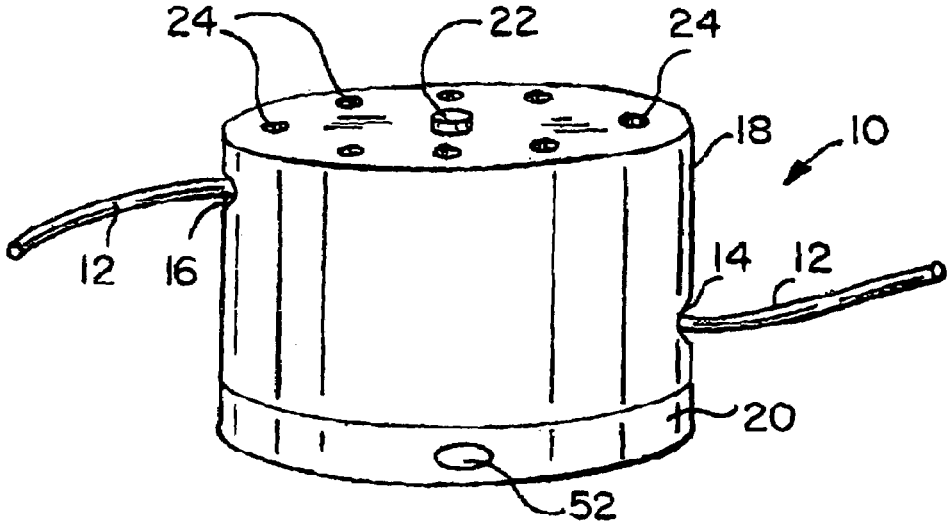
FIG. 1 is a perspective of the preferred embodiment of the invention showing tubing emerging from the upper and lower apertures of the elongate material apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative foundation for teaching one skilled in the art to variously employ the present invention in virtually any appropriately detailed structure.

References are now made to the drawings wherein like characteristics and features of the present invention shown in the various figures are designated by the same reference numerals.

Figure 3:
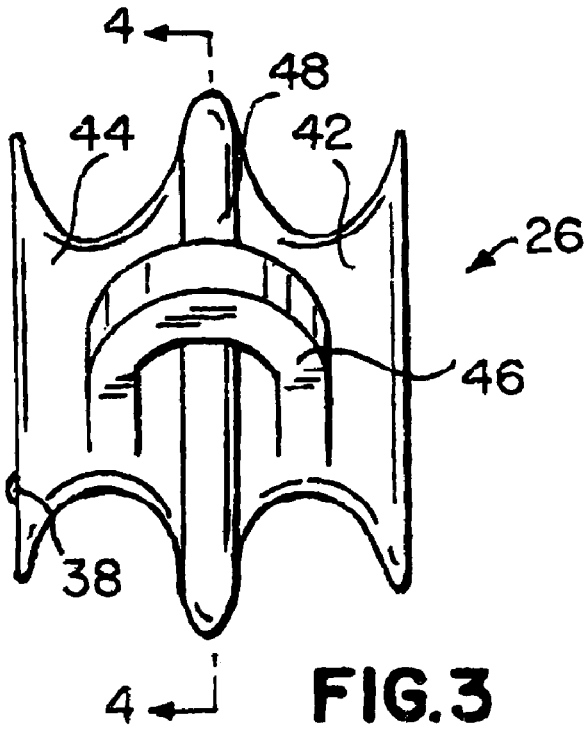
FIG. 3 is a side view of the dual spool showing the u-turn channel that is used to reverse the direction of the tubing.

FIG. 1 is a perspective view of the assembled elongate material apparatus 10 showing tubing 12 emerging from a lower aperture 14 and upper aperture 6 in housing 18. Housing 18 is removably connected to and supported by base plate 20. Base plate 20 supports a spindle 22 shown penetrating the top of housing 18. Housing 18 is shown with its top perforated by a series of holes 24 which cooperate with a spring loaded button 38 on dual spool 26 as seen in FIG. 3. Release button 52 is seen on the side of base plate 20. Its function and interrelationship with other functions will now be described.

The inventive apparatus is equipped with certain features and controls to make it easy to operate. First, the housing 18 and base plate 20 are provided with an interlock such that they cannot be opened to replace elongate material such as tubing 12 unless the tubing 12 is fully unwound. The reason is to fully tension the torsion spring 32. The interlock does two things: (1) requires full tensioning on the torsion spring to open the housing 18 and base plate 20, and (2) activates a stop to keep the torsion spring at full tension. Thus, when housing 18 is removed from base plate 20, tubing 12 or other elongate material will have been fully unwound because of the interlock. It can then be readily lifted out of u-turn channel 46 and replaced with new tubing 12. The housing 18 and base plate 20 are reassembled. Then release button 52 causes the stop on the dual spool to be released so that the torsion spring 32 (seen in FIG. 2) can wind up a new elongate material on dual spool 26.

Figure 2:
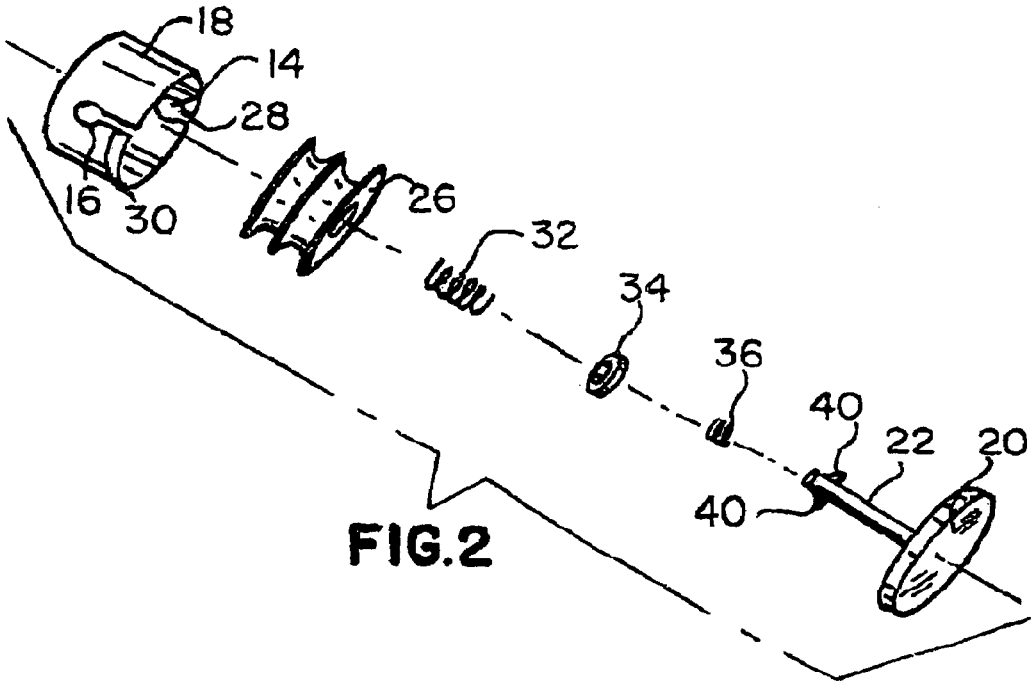
FIG. 2 is an exploded view of the elongate material apparatus showing the housing, dual spool, torsion spring, pressure plate, compression spring, spindle and base plate combination.

FIG. 2 is an exploded view of the elongate material apparatus. Housing 18 is shown with lower aperture 14, upper aperture 16, lower aperture slot 28 and upper aperture slot 30. The slots facilitate the insertion of the tubing without threading the entire half length of the tubing through each of the apertures. Next to housing 18 is shown dual spool 26. The next element is torsional spring 32 which acts as a torsional drive for the dual spool 26. Next is compression plate 34 and compression spring 36. This is followed by base plate 20 connected to spindle 22 having locking tabs 40.

Turning next to FIG. 3, there is shown a side view of dual spool 26 having a first half 42 servicing lower aperture 14 and a second half 44 servicing upper aperture 16. Also seen is u-turn channel 46 for reversing the direction of the tubing without collapsing it. Common wall 48 includes u-turn channel 46. On the top of dual spool 26 is spring loaded button 38 to interact in a ratchet and pawl fashion with holes 24 as seen in FIG. 1. It is equipped with an internal disabling function activated by pushing the button down to a recessed locking position. The latter mode of operation is indicated when the invention is used with an oxygen tank and a breathing tube on an elderly patient who could not be expected to remember to tug on the tubing to resume winding and tension when walking closer to the oxygen tank.

Figure 4:
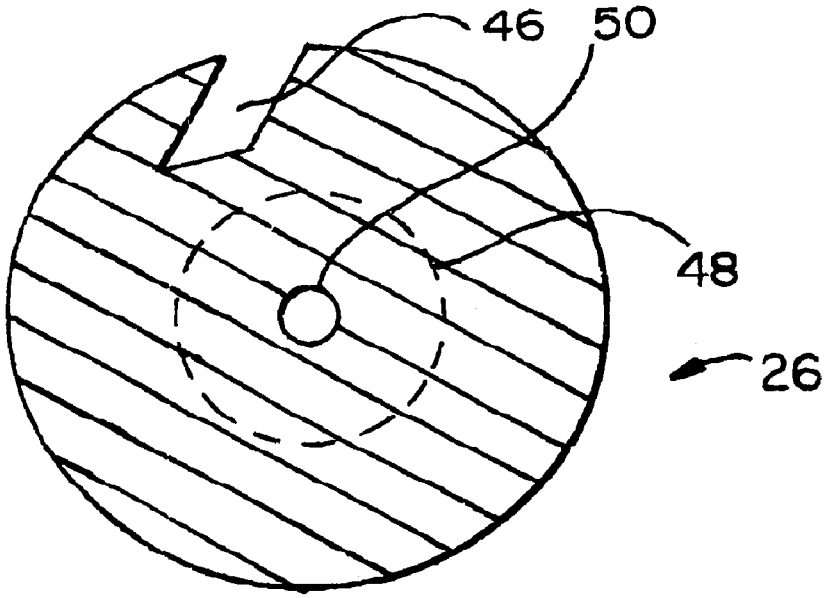
FIG. 4 is a cross sectional view taken along the line 4—4 of FIG. 3.

FIG. 4 is a cross sectional view of dual spool 26 taken along the line 4—4 of FIG. 3. U-turn channel 46 is seen in a side view to show its sloped design to capture and retain elongate material and it generous size to avoid collapsing tubing. Also seen in phantom is minimum diameter 48 of second half 44 (as seen in FIG. 3). Center opening 50 is to accommodate spindle 22 (as seen in FIGS. 1 and 2.

While the invention has been described, disclosed, illustrated and shown in various terms or certain embodiments or modifications which it has assumed in practice, the scope of the invention is not intended to be, nor it should be, deemed to be, limited thereby an such other modifications and embodiments as may be suggested by the teachings herein are particularly reserved especially as they fall within the breadth and scope of the claims that follow.

What is claimed is:

1. An elongate material management apparatus comprising:

a housing having at least one aperture;

a base plate removably connected to the housing;

a spindle supported by the base plate;

a dual spool having a u-turn channel and being rotatably mounted on the spindle;

a compression plate and compression urging device disposed on the spindle on a first side of the dual spool and locking tabs disposed on the spindle on a second side of the dual spool to maintain a fixed position of the dual spool on the spindle; and a torsion drive to wind up the elongate material from a point disposed between ends of the elongate material.

2. The elongate material management apparatus of claim 1 in which the at least one aperture in the housing is preferably two apertures, a first aperture and a second aperture through which elongate material is wound and unwound from the dual spool.

3. The elongate material management apparatus of claim 2 which further comprises a first aperture slot and a second aperture slot respectively connecting the apertures to an open end of the housing when the base plate is removed.

4. The elongate material management apparatus of claim 1 in which the torsion drive is a coil spring.

5. The elongate material management apparatus of claim 1 in which the compression urging device is a compression spring.

6. The elongate material management apparatus of claim 1 which further comprises a ratchet and pawl to selectively maintain the dual spool in a stationary posture without tension on the elongate material when winding and unwinding are not needed.

7. The elongate material management apparatus of claim 6 in which the ratchet and pawl is comprised of a plurality of recesses disposed in a circle on top of the housing and a resiliently urged button disposed on top of the dual spool to interact with the recesses.

8. An elongate material management apparatus comprising:

a housing having a first aperture and a second aperture, an open end, and slots from each aperture to the open end;

a base plate removably connected to the housing at the open end;

a spindle supported by the base plate;

a dual spool having a u-turn channel, being rotatably mounted on the spindle, and adapted to wind and unwind the elongate material through the apertures;

a compression plate and compression urging device disposed on the spindle on a first side of the dual spool and locking tabs disposed on the spindle on a second side of the dual spool to maintain a fixed position of the dual spool on the spindle;

a torsion drive to wind up the elongate material from a point disposed between ends of the elongate material; and a ratchet and pawl to selectively maintain the dual spool in a stationary posture without tension on the elongate material when winding and unwinding are not needed.

9. The elongate material management apparatus of claim 8 in which the compression urging device is a compression spring.

10. The elongate material management apparatus of claim 8 in which the ratchet and pawl is comprised of a plurality of recesses disposed in a circle on top of the housing and a resiliently urged button disposed on top of the dual spool to interact with the recesses.

11. The elongate material management apparatus of claim 8 in which the torsion drive is a coil spring.

* * * * *